US008188394B2

(12) United States Patent
Mccormick et al.

(10) Patent No.: US 8,188,394 B2
(45) Date of Patent: May 29, 2012

(54) UNIVERSAL TERMINATION SYSTEM FOR POWER TOOLS

(75) Inventors: Garrett P. Mccormick, Manchester, MD (US); Michael A. Zemlock, North Haven, CT (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 13/195,200

(22) Filed: Aug. 1, 2011

(65) Prior Publication Data

US 2011/0318976 A1 Dec. 29, 2011

Related U.S. Application Data

(62) Division of application No. 11/920,034, filed as application No. PCT/US2006/018105 on May 11, 2006.

(60) Provisional application No. 60/679,961, filed on May 11, 2005.

(51) Int. Cl.
*H01H 1/64* (2006.01)

(52) U.S. Cl. ..... 200/293; 439/188

(58) Field of Classification Search ..... 200/293, 200/237, 51.03, 51.02, 51.06, 51.7, 238, 200/253.1, 258; 439/877, 800, 374, 188, 439/455, 568, 849, 850, 881, 884; 29/622
See application file for complete search history.

(56) References Cited

U.S. PATENT DOCUMENTS 3,771,111 A * 11/1973 Pritulsky ..... 439/850
4,118,614 A 10/1978 Leibundgut
4,241,298 A 12/1980 Trammell, Jr. et al.
4,258,368 A 3/1981 Arnold et al.
(Continued)

FOREIGN PATENT DOCUMENTS

DE 2631994 A1 1/1978
(Continued)

OTHER PUBLICATIONS

International Search Report and Written Opinion of the International Searching Authority mailed Jul. 3, 2008 for PCT/US06/18105, filed May 11, 2008.

*Primary Examiner* — Edwin A. Leon
(74) *Attorney, Agent, or Firm* — Amir R. Rohani

(57) ABSTRACT

A universal termination system is provided for power tools. The universal termination system includes criteria for each of the main switch platforms that define the number, type, location and orientation of the terminations. That is, the number, type, location and orientation of the terminations in each main switch platform are standardized and the power tools that use that type main switch platform use the main switch platform having the standardized terminations. That is, power tools that use push button switches use the push button switch with the standardized terminations, power tools that use overhang switches use the overhang switch with the standardized terminations, and power tools that use in-line VSR switches use the in-line VSR switch with the standardized terminations. In an aspect of the invention, a right-angle pin terminal is received in one or more sets of the standardized terminations. In an aspect of the invention, the switch body has features that cooperate with the right-angle pin terminals to reduce the risk of shorting adjacent terminals. In an aspect of the invention, a switch has standardized connections on a bottom of a switch body that mate with terminals of a plug-in control module. In an aspect of the invention, a switch for a hand-held power tool has cord set terminations that are screw-tab terminals.

10 Claims, 14 Drawing Sheets

U.S. PATENT DOCUMENTS

| | | | | |
|---|---|---|---|---|
| 4,491,752 | A | 1/1985 | O'Hara et al. | |
| 5,579,902 | A | 12/1996 | Kress | |
| 5,714,861 | A | 2/1998 | Hansen et al. | |
| 5,798,584 | A | 8/1998 | Schaeffeler et al. | |
| 5,835,351 | A | 11/1998 | Ulanski et al. | |
| 6,086,433 | A * | 7/2000 | Hils et al. | 439/849 |
| 6,340,321 | B2 * | 1/2002 | Sawayanagi | 439/877 |
| 6,540,545 | B1 | 4/2003 | Itakura et al. | |
| 6,551,123 | B1 | 4/2003 | Schaeffeler et al. | |
| 6,555,775 | B1 | 4/2003 | Van Bokhoven et al. | |
| 6,997,746 | B2 * | 2/2006 | Taylor | 439/585 |
| 7,121,893 | B2 | 10/2006 | Broghammer et al. | |
| 7,148,433 | B1 | 12/2006 | Rudy, Jr. | |
| 7,186,940 | B1 | 3/2007 | Wong | |

FOREIGN PATENT DOCUMENTS

| | | | |
|---|---|---|---|
| DE | 8527798 | U1 | 12/1985 |
| DE | 4038787 | A1 | 6/1992 |
| DE | 19635102 | A1 | 3/1998 |
| DE | 102005001748 | A1 | 7/2006 |
| DE | 102006000975 | A1 | 7/2006 |
| DE | 102007005509 | A1 | 8/2007 |
| DE | 102007005510 | A1 | 8/2007 |
| EP | 0235735 | A1 | 9/1987 |
| WO | WO-2006045657 | A1 | 5/2006 |
| WO | WO-2007074131 | A1 | 7/2007 |
| WO | WO-2007079716 | A1 | 7/2007 |

* cited by examiner

UNIVERSAL TERMINATION SYSTEM FOR POWER TOOLS

CROSS-REFERENCE TO RELATED APPLICATIONS

This application is a divisional of U.S. application Ser. No. 11/920,034 filed Feb. 11, 2009, which is a National Stage of International application No. PCT/US2006/018105, filed May 11, 2006. PCT/US2006/018105 claims the benefit of U.S. Provisional Application No. 60/679,961, filed May 11, 2005. The entire disclosures of each of the above applications are incorporated herein by reference.

FIELD OF THE INVENTION

The present invention relates to power tools, and more particularly, to termination systems for switches used in power tools.

BACKGROUND OF THE INVENTION

Standardizing electrical components in power tool applications, such as hand-held power tools, are hampered by the very different demands of the wide range of applications, particularly, the types of motors and switches used. As power tools have evolved, performance, cost and ergonomics have caused power tool manufacturers to use many different electrical configurations.

This push toward customized solutions has resulted in situations where even for a single type of application, electrical drills for example, different switch suppliers have developed different switch platforms. While these different switch platforms typically have comparable performance ratings, they tend to differ widely in the number, type, location and orientation of their terminations. Where the power tool manufacturer "dual sources" the switch, this has the undesirable effect of propagating multiple different "wire-ups" depending on the switch selected. A "wire-up" is a term commonly used to refer to the wiring arrangement used in the tool. These variations in wire-ups then necessitate different cord sets, motor lead wire terminations and lengths, as well as requiring that various peripherals such as EMI filters and electronics be connected differently.

The overall impact of having different switch platforms from different suppliers for the same power tool application results in reduced design flexibility, complicates the supply chain, and increases the potential for confusion and error during assembly of the power tool. Since the potential for customizing existing switches is limited, each new power tool that uses that switch platform tends to evolve towards a sub-optimal wire-up with more unnecessary connections as well as more complex wire routings.

Power tools, and in particular, hand-held power tools, use three main switch types depending on the application. These are push-button, in-line and overhang. Push-button switches are simply on/off switches and their main application is in small angle grinders. In-line switches are typically used in drills, hammer drills, and screw guns. In-line switches often include a variable speed control where a device such as a potentiometer controls the output of a power electronics circuit that powers a motor. They may also have an integrated mechanism to reverse the motor. Such in-line switches are often known as "variable speed reversing" or "VSR" switches. Overhang switches are used in most saw applications (e.g., miter saws, circular saws and reciprocating saws.

With the exception of the overhang switches used in certain reciprocating saws, such as those having variable speed, overhang switches are also generally simply on/off switches. Overhang switches used in reciprocating saws having variable speed typically include control electronics that provides the variable speed function.

Push Button Switch

One of the challenges posed by today's push button switches is that they have a boxlike form that must be accommodated in small, handheld tools such as grinders where ergonomics are important selling features. The packaging of various electrical components in such a tool can be difficult, particularly with the advent of tools having more features which often have separate electronic controls.

With reference to FIG. 1, a typical prior art push button switch 100 has a body 102 with an internal push-button actuator and an external actuator, such as a button 104, extending from a top 106. As oriented herein, the term "top" or "front" is used to refer to the side of the switch having the actuator, such as button 104, the term "bottom" or "back" is used to refer to the side of the switch opposite the side having the actuator, and the term "side" is used to refer to the remaining sides of the switch. Push button switch 100 also has tab or screw terminals (not shown) on a bottom 108 to secure the leads, typically two, from a cord set (not shown). It also typically has tab terminals 110 (only one of which is shown) on bottom 108 to secure motor leads 112 (only one of which is shown in FIG. 1) and to secure the EMI capacitor (not shown). It should be understood that the external actuator could be other than a button, such as a rocker, a slide, a paddle, or the like. Push button switch 100 might then be known as a slide switch, rocker switch, or paddle switch, respectively.

A disadvantage of tab terminals is that when the requisite connector 114, such as a Faston type connector available from Tyco, is plugged onto the tab terminal 110, the body of the connector 114 extends well beyond the bottom 108 of the body 102 of push button switch 100. This significantly increases the axial length of the envelope occupied by the push button switch 100 and connectors that plug onto the tab terminals. This often results in the need to bend the connectors and/or severely kink the lead wires. This makes assembly difficult and can present the possibility of subsequent failure due to damaged wires or terminals.

Overhang Switch

Most overhang switch applications are relatively simple and require only on/off operation. But newer power tool applications, such as features that are becoming standard in saws, require a more complex overhang switch application. These features include a dynamic brake, such as a brake winding that is shorted through the armature of the motor when the trigger switch of the power tool is released, or an electronic brake that operates in conjunction with the run winding of the motor. Also, laser sight lines in miter and some circular saws are becoming increasingly popular and these require separate power supplies that must be wired into the overhang switch.

There are three main switch terminations typically used in overhang switches. They are tab terminals, side-mounted screw terminals (as oriented when the power tool is upright), and bottom-mounted screw terminals (again as oriented when the power tool is upright).

FIG. 2 shows an overhang switch 200 having the tab terminal type of connections. Overhang switch 200 typically has four tab terminals 202 (only two of which are shown) that extend from a body 204, illustratively with two tab terminals 202 extending from one side of switch body 204 and the other two tab terminals extending from an opposite side of switch body 204. Overhang switch 200 has a switch actuator 206, such as a trigger, at a top or front 208. (In FIG. 2, overhang switch 200 is oriented so that its bottom side is up.) Ends of leads 210 have insulated Faston type connectors 212 attached thereto and the Faston connectors are placed on tab terminals 202 to connect leads 210 to overhang switch 200. While this simplifies assembly as the Faston type connector can be placed on the tab terminals without the need to use a dedicated tool to do so, it is less than ideal if additional connections (such as may be required for a power supply for a laser sight line) are needed over and above the four tab terminals that are typically provided. Also, tab terminals typically can't handle as high a current as screw terminals and if the Faston connector isn't fully inserted over the tab terminal, it may increase the possibility of failure. Insulated Faston connectors are also more expensive than standard ring terminals used with screw terminals.

FIG. 3 shows an overhang switch 300 having the side-mounted screw terminal type of connections. Elements of overhang switch 300 in common with elements of overhang switch 200 of FIG. 2 will be identified with the same reference numbers and only the differences will be discussed. Overhang switch 300 is oriented in FIG. 3 with its bottom side up. Overhang switch 300 includes screw terminals 302 on opposite sides of switch body 204. Ring terminals 304 are affixed to ends of leads 210 and are fastened to screw terminals 302 by screws 306.

Using side-mounted screw terminals in lieu of tab terminals solves some of the above noted problems attributable to the use of tab terminals, but creates others. Screw terminals can handle higher current than Faston type connectors and allow for multiple connections. They also cost less than insulated Faston connectors and the screw connections tends to be more robust than the slip-on connection provided by Faston connectors. But the location of the screw terminals on the side of the switch bodies presents some difficulties. For example, as shown in the circled portion 307 of FIG. 3, the screw(s) 306 located directly under the trigger 206 are difficult to access. Also, to minimize the axial length of overhang switch 300, screw terminals 302 are typically not much thicker than tab terminals 202, which means that the threaded portions of screw terminals 302 are not much thicker than tab terminals 202. As such, the threaded portion of screw terminals 302 has few threads, perhaps one or less, so that the threaded engagement between screws 306 and screw terminals 302 is not particularly robust. This may result in stripped threads, such as during assembly or later service if screws 306 are over tightened. Further, since the ring terminals 304 are fastened to sides of switch body 204, the bodies of the ring terminals 304 extend beyond a bottom 308 of switch body 204. This means that the ring terminals 304 must be bent at an appropriate angle to avoid touching the inside of the handle of the power tool (not shown) having overhang switch 300. Practically, this requires that the handle of the power tool have more room behind the overhang switch 300, often resulting in the girth of the handle being larger. This can be detrimental since the width and girth of a power tool handle, particularly for power tools of the type that use overhang switches, are often important ergonomic criteria. Also, a dedicated tool is typically required to fasten the screws 306 into the screw terminals 302 during assembly of the power tool.

FIG. 4 shows an overhang switch 400 having the bottom-mounted screw terminals type of connections. Elements of overhang switch 400 in common with elements of overhang switches 200 of FIGS. 2 and 300 of FIG. 3 will be identified with the same reference numbers and only the differences will be discussed. Overhang switch 400 is oriented in FIG. 4 with its bottom side up. Overhang switch 400 includes screw terminals 402 mounted on bottom 308 of switch body 204. In addition to the advantages of using screw terminals as discussed above with respect to overhang switch 300 of FIG. 3, since screw terminals 402 are mounted on the bottom 308 of body 204, they can be thicker or include deep, threaded bushings, that minimize or even eliminate the possibility of stripped threads, both during assembly and in the event of later service. The bottom-mounted screw terminals 402 are also more ergonomic because they are easier to access. Also, the ring terminals 304 don't need to be bent nor do the leads 210 need to be kinked as the leads 210 can exit directly from the sides of the switch body 204. Further, the connections between ring terminals 304 and screw terminals 402 are flush with the bottom 308 of switch body 204.

In-Line (VSR)

In-line switches, particularly in-line VSR switches, tend to be the most complicated switches presently used in power tool applications. This is due to the electronic content of these switches, the multiple connections that they must accommodate and the multiple configurations commonly used.

There are two main schemes used in in-line VSR switches: the 4-wire (asymmetrical) wire-up and the 6-wire (symmetrical) wire-up. The 4-wire scheme is typically used in 120 VAC applications where there isn't an EMI requirement and the two coils of the field winding are connected in series on one side of the armature (hence asymmetric). In the 6-wire scheme, the 2 coils of the field winding are connected one on each side of the armature (hence symmetric).

The 4-wire scheme is illustrated in more detail in FIG. 5 for an in-line VSR switch 500 having a reversing box 518 with reversing box connections 503, 504 connected to an armature 516 of an electric motor 514 and reversing box connections 506, 507 connected to field windings 510 of a field 512 of electric motor 514. In-line VSR switch 500 also includes cord set connections 501 and 502 connected to cord set 518.

The 6-wire scheme is illustrated in more detail in FIG. 6. In the 6-wire scheme, the two field coils 600 of the field 602 of electric motor 604 are connected one on each side of the armature 606 of electric motor 604 to reversing box connections 618, 620 of a reversing box 622 of an in-line VSR switch 608 and to motor connections 630, 632 of in-line VSR switch 608. Armature 606 of electric motor 604 is connected to reversing box connections 624, 628. In-line VSR switch 608 also includes cord set connections 610 connected to a cord set 612. It also includes EMI connections 614 connected to an EMI capacitor 616. In the 6-wire scheme, the two coils of the field winding are connected one on each side of the armature 606 to utilize the inductance of field coils 600 to act as a filter for any electrical noise generated at the brush/commutator interface of armature 606 and mitigate the need for additional EMI components.

The next consideration is the form of the tool itself, which generally falls into two major classes: pistol grip and mid-handle. A pistol grip has the shape, as the name implies, of a pistol grip and the handle and switch are aft of the motor and most of the wiring enters from above or below the switch. In this configuration, terminals on the top or bottom of the switch are preferred while terminals on the side of the switch body are inconvenient since they are difficult to access and make wire routing difficult. In power tools having pistol grip handles, such as drills, width and girth of the handle are important ergonomic criteria so it is desirable not to have to increase either to make access to the terminals and/or wire routing easier.

In the mid-handle design, the handle and switch are located directly under the motor so lead wires exiting from the top of the switch are undesirable. This is further complicated by the range of terminals used by various switch manufacturers, ranging from tab terminals of various sizes, locations and orientations, to push-in type terminals. Push in type terminals are internal to the switch and typically consist of two parts—a spring arm and a supporting plate. The lead wire (or pin type terminal) is inserted between the plate and the spring arm and is secured by the spring force of the spring arm pressing it against the plate.

SUMMARY OF THE INVENTION

In accordance with an aspect of the invention, a universal termination system is provided for power tools. The universal termination system includes criteria for each of the main switch platforms that define the number, type, location and orientation of the terminations. That is, the number, type, location and orientation of the terminations in each main switch platform are standardized and the power tools that use that type main switch platform use the main switch platform having the standardized terminations. That is, power tools that use push button switches use the push button switch with the standardized terminations, power tools that use overhang switches use the overhang switch with the standardized terminations, and power tools that use in-line VSR switches use the in-line VSR switch with the standardized terminations.

A push button switch having a universal termination system in accordance with an aspect of the invention has terminals for the motor connections that are of a type and orientation so that the lead wires to the power tool motor exit the push button switch perpendicular to an axis that extends through the body of the switch and the actuator. For example, when the actuator is a push button, the lead wires exit the push button switch perpendicular to the direction of actuation of the push button.

An overhang switch platform having a universal termination system in accordance with an aspect of the invention utilizes an overhang switch having bottom mounted screw terminals.

An in-line VSR switch platform having a universal termination system in accordance with an aspect of the invention has push-in type terminals for the cord set, capacitor, reversing box and motor connections. The push-in type terminals for the cord set and capacitor are disposed on the bottom surface of the switch body (as in known in-line VSR switches). A release mechanism is provided to release the push-in terminals for the cord set connections to eliminate the need to use a tool to release the cord set leads from the push-in terminals. The push-in type terminals for the reversing box connections are disposed in the sides of the switch body generally at the top of the switch body. The push-in type terminals for the motor connections are disposed in a side of the switch body toward the top of the switch body (such as in the top 40% of the switch body). The in-line VSR switch platform further includes push-in type terminals for the reversing box connections which are disposed on sides of the top of the switch body.

In accordance with another aspect of the invention, a right-angle pin terminal is received in one or more sets of the push-in terminals of the switch.

In an aspect of the invention, the right-angle pin terminals when received in push-in terminals of a switch can be rotated 360 degrees to facilitate use of the switch in different applications without introducing kinks in the lead wires and/or severe bends in the terminals. They also allow the connections to exit the switch almost flush with sides of the switch.

In an aspect of the invention, the switch body of a switch utilizing the right-angle pin terminals has features formed therein that cooperate with the right-angle pin terminals to help prevent inadvertently shorting adjacent terminals.

In an aspect of the invention, the right-angle pin terminal has a barrel portion extending at right angles from a wire receiving portion. In a variation, the barrel portion extends through the bend to stiffen the right-angle pin terminal.

In another aspect of the invention, a switch has standardized connections on a bottom of a switch body that mate with terminals of a plug-in control module.

In an aspect of the invention, a switch for a hand-held power tool has cord set terminals that are screw-tab terminals.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

In accordance with an aspect of the invention, a universal termination system is provided for power tools. The universal termination system includes criteria for each of the main switch platforms that define the number, type, location and orientation of the terminations. That is, the number, type, location and orientation of the terminations in each main switch platform are standardized and the power tools that use that type main switch platform use the main switch platform having the standardized terminations. That is, power tools that use push button switches use the push button switch with the standardized terminations, power tools that use overhang switches use the overhang switch with the standardized terminations, and power tools that use in-line VSR switches use the in-line VSR switch with the standardized terminations.

Push Button Switch

Figure 1:
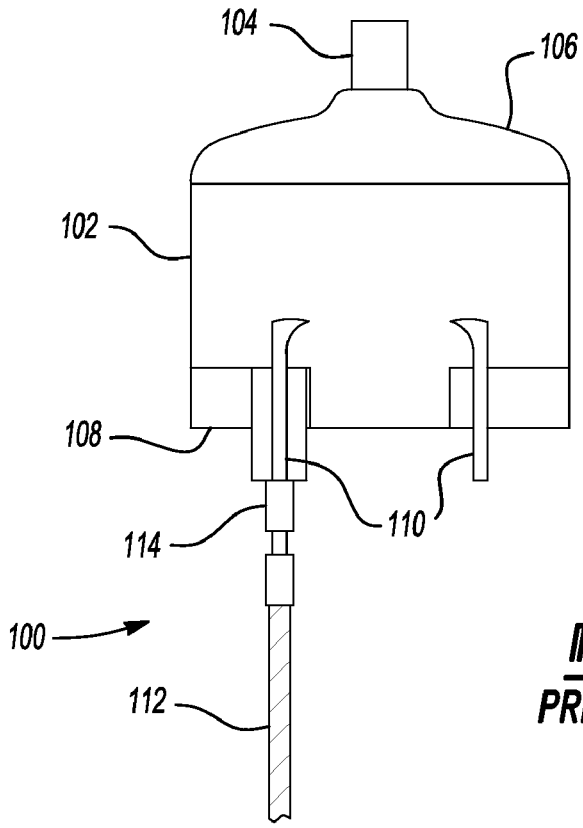
Fig-1 PRIOR ART
FIG. 1 is a side perspective view of a prior art push button switch.
Figure 2:
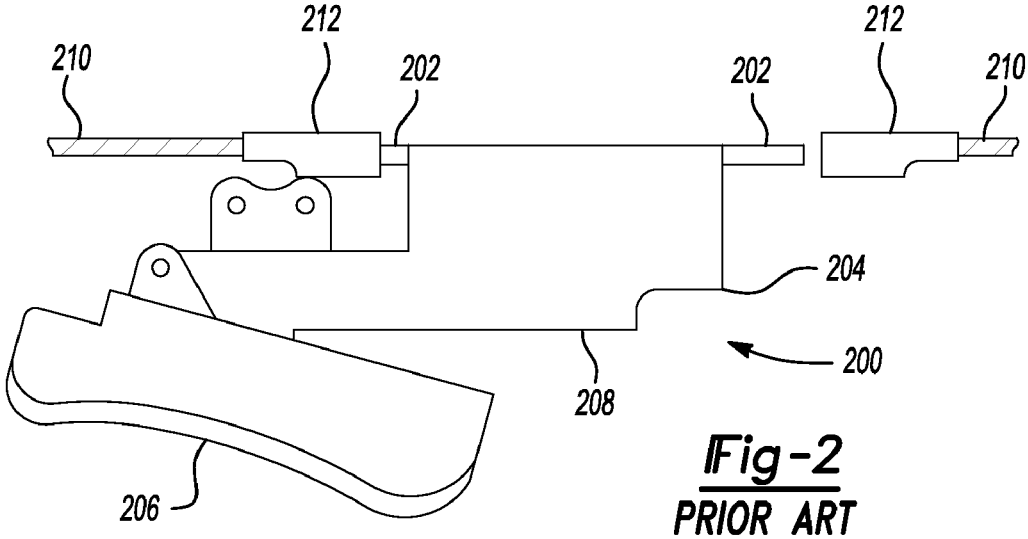
Fig-2 PRIOR ART
FIG. 2 is a side perspective view of a prior art overhang switch having tab terminals
Figure 3:
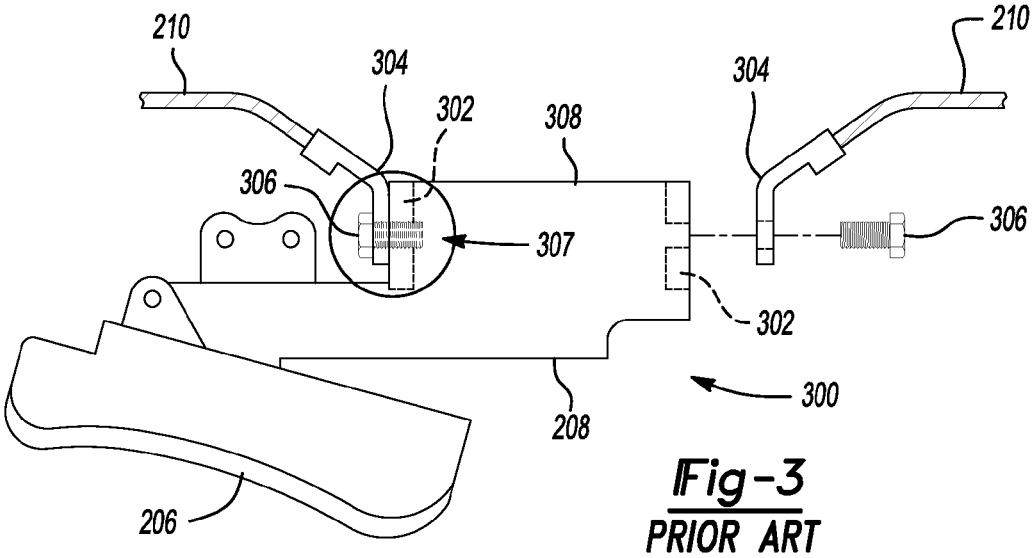
Fig-3 PRIOR ART
FIG. 3 is a side perspective view of a prior art overhang switch having side-mounted screw terminals.

A push button switch platform having a universal termination system in accordance with an aspect of the invention has terminals for the motor connections that are of a type and orientation so that the lead wires to the power tool motor exit the push button switch perpendicular to an axis that extends through the body of the switch and the actuator. For example, when the actuator is a push button, the lead wires exit the push button switch perpendicular to the direction of actuation of the push button. When, for example, the button of the push button switch is pressed into the front of the body of the push button switch, the motor lead wires exit from the side of the push button switch and not the bottom as in the push button switch 100 of FIG. 1. In a variation, the terminals for the cord set are also of a type and orientation so that the wires of the cordset also exit the push button switch perpendicular to the direction of actuation of the push button.

Figure 7:
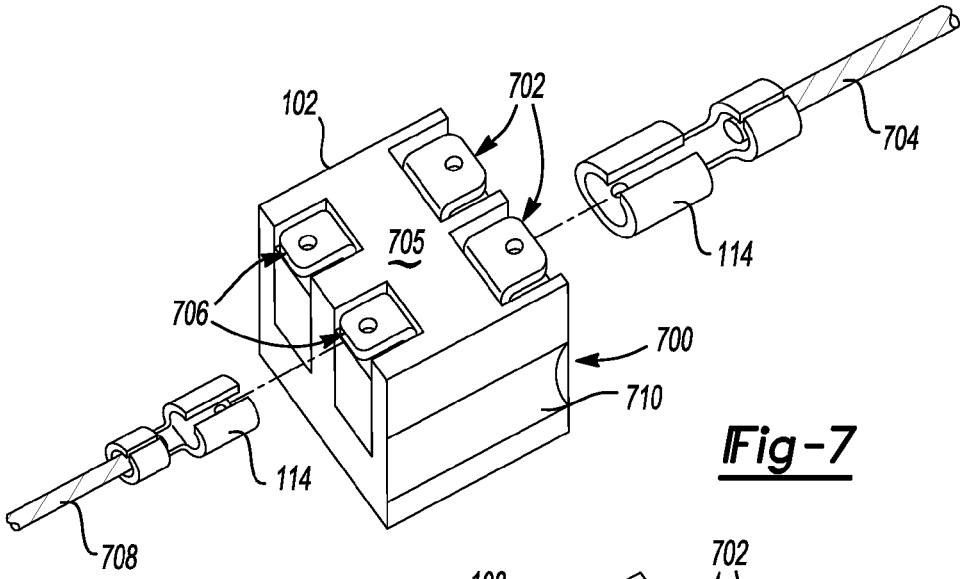
FIG. 7 is a side perspective view of a push button switch in accordance with an aspect of the invention.

With reference to FIG. 7, a push button switch 700 having a universal termination system in accordance with an aspect of the invention is shown. Elements in common with the elements of push button switch 100 of FIG. 1 will be identified with the same reference numbers and only the differences will be discussed. In push button switch 700, tab terminals 702 for the motor leads 704 (only one of which is shown in FIG. 7) and tab terminals 706 for cord set leads 708 (only one of which is shown in FIG. 7) are disposed in bottom 108 of body 102. In contrast to push button switch 100 of FIG. 1, tab terminals 702, 706 are bent so that they project parallel to surface 705 of bottom 108 of body 102 of push button switch 700. In the embodiment of FIG. 7, tab terminals 702 extend toward one side of body 102 and tab terminals 706 extend toward an opposite side of body 102. When the connectors 114 of the motor leads 704 and the connectors 114 of the cord set leads 708 are placed on tab terminals 702, 706, respectively, the motor leads 704 and cord set leads 708 exit from body 102 in a direction that is perpendicular to the direction of actuation of button 104 (not shown in FIG. 7).

Push button switch 700 further includes a carrier 710 for an EMI capacitor (not shown). Carrier 710 may illustratively be integral with body 102. Including carrier 710 as part of push button switch 700 even though EMI capacitors are not used in all applications (typically, low voltage applications) advantageously provides space for the EMI capacitor in those applications where it is used (typically, high voltage applications) and eliminates the need for wiring changes between low and high voltage applications.

Figure 8:
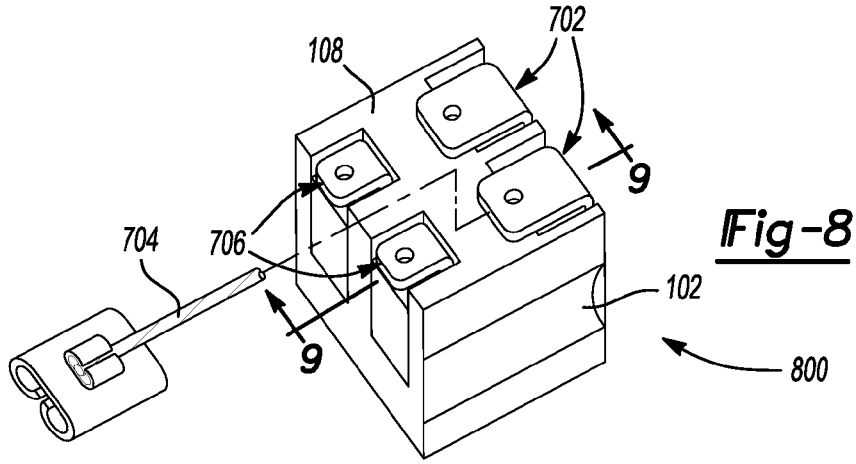
FIG. 8 is a side perspective view of another push button switch in accordance with an aspect of the invention.
Figure 9:
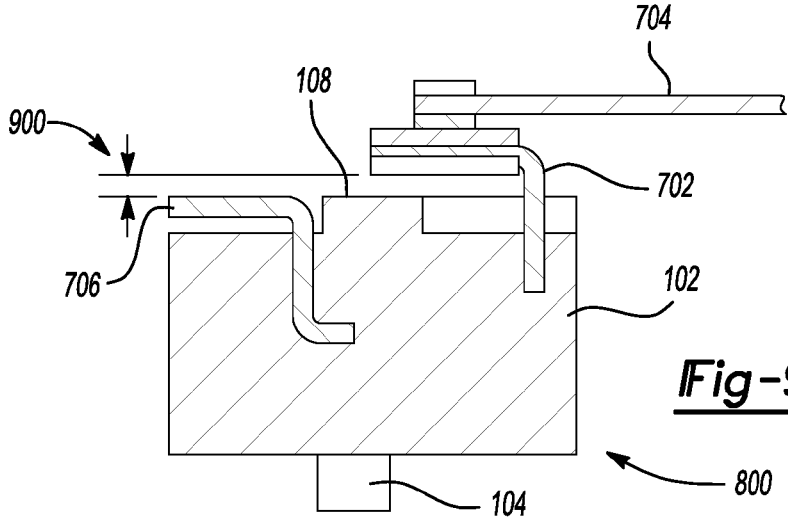
FIG. 9 is a side sectional view of the push button switch of FIG. 8 taken along the line 9-9 of FIG. 8.

FIGS. 8 and 9 show a push button switch 800 that is a variation of the push button 700 of FIG. 7. Elements in common will be identified with the same reference numbers and only the differences will be discussed. Push button switch 800 also has tab terminals 702, 706 disposed in bottom 108 of body 102. Tab terminals 702, 706 extend toward the same side of body 102, not opposite sides as in push button switch 700. Tab terminals 702, 706 are vertically staggered with respect to each other as best shown at 900 in FIG. 9. An Faston type terminal having an insulation displacing crimp wire receptacle is affixed to the ends of motor leads 704 in lieu of a Faston type terminal so that motor leads 704 and cord set leads (not shown in FIG. 8) can exit push button switch 800 from opposite sides.

While push button switches 700 and 800 were shown with tab terminals 702, 706, it should be understood that screw terminals could be used in lieu of tab terminals 702.

Figure 13:
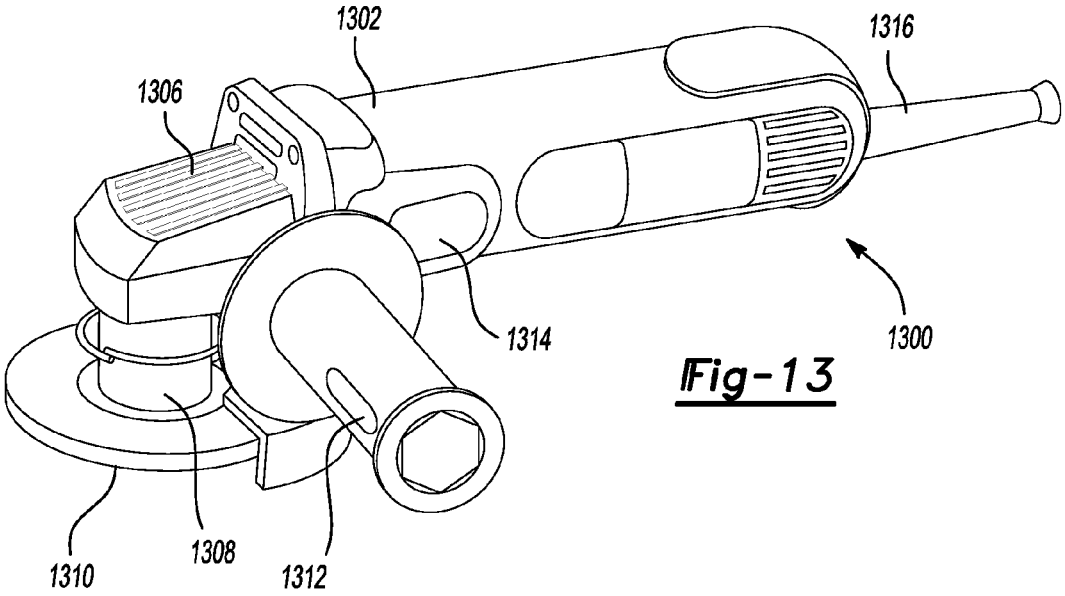
FIG. 13 is a side perspective view of a power tool having a push button switch.

Referring to FIG. 13, a power tool 1300 having push-button switch 700 is shown. Power tool 1300 is illustratively shown as a small angle grinder having a push-button switch 1302 with a slide actuator, but it should be understood that power tool 1300 can be any power tool requiring a push button switch platform. Grinder 1300 has the same basic characteristics as prior art grinders, such as a DEWALT® DW818 small angle grinder. In this regard, FIG. 13 is closely identical to an illustration of the DW818 small angle grinder, which is used for convenience of illustration as it shows the basic components of a grinder.

Grinder 1300 includes a housing 1302 surrounding a motor (not shown) that is coupled to a gear case assembly 1306. Gear case assembly is also attached to one end of housing 1302. Gear case assembly 1306 is coupled to a spindle assembly 1308 to which a grinding wheel or disc 1310 is attached. A handle 1312 is attached to one side of gear case assembly 1306. Grinder 1300 differs from the DW818 prior art grinder in that switch 1314 utilizes the push button switch platform in accordance with an aspect of the invention as described above with reference to push button switches 700 and 800. The motor is electrically coupled through switch 1314 to a source of power by power cord 1316.

Overhang Switch

Figure 4:
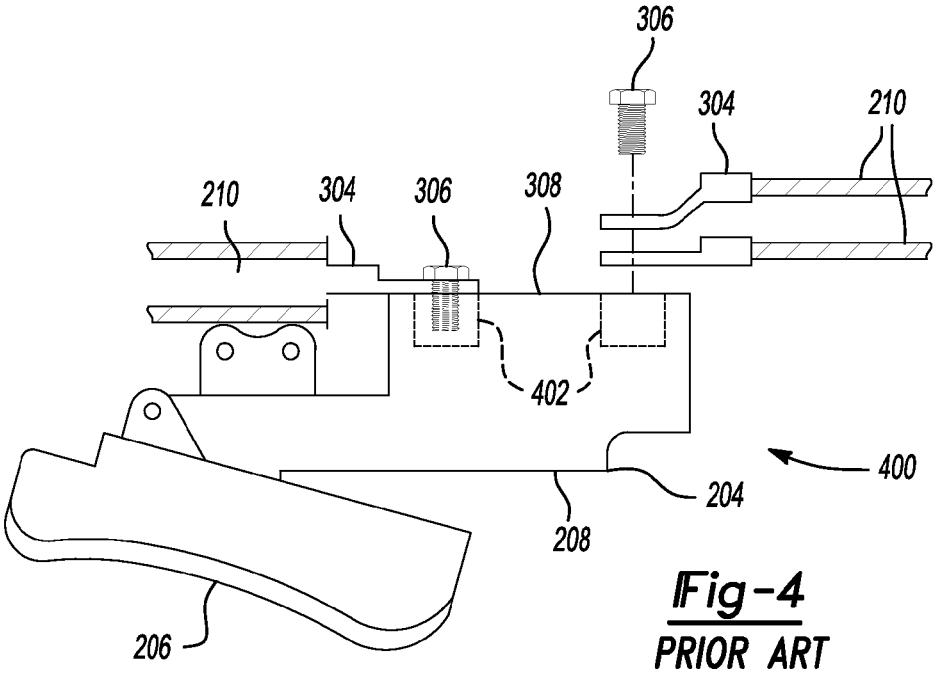
Fig-4 PRIOR ART
FIG. 4 is a side perspective view of a prior art overhang switch having bottom mounted screw terminals.
Figure 5:
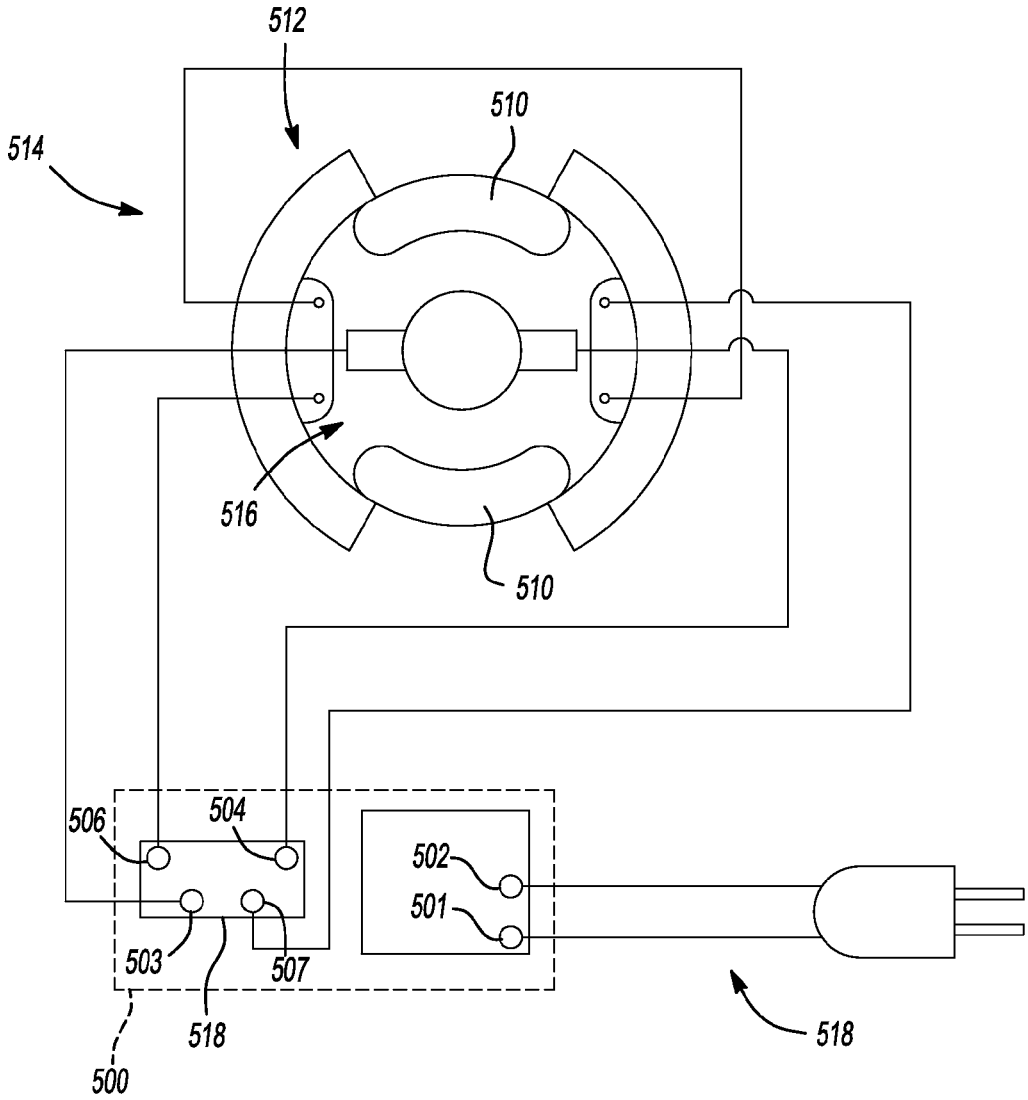
Fig-5 PRIOR ART
FIG. 5 is a simplified wiring diagram of a prior art in-line VSR switch for a 4-wire wire-up.
Figure 6:
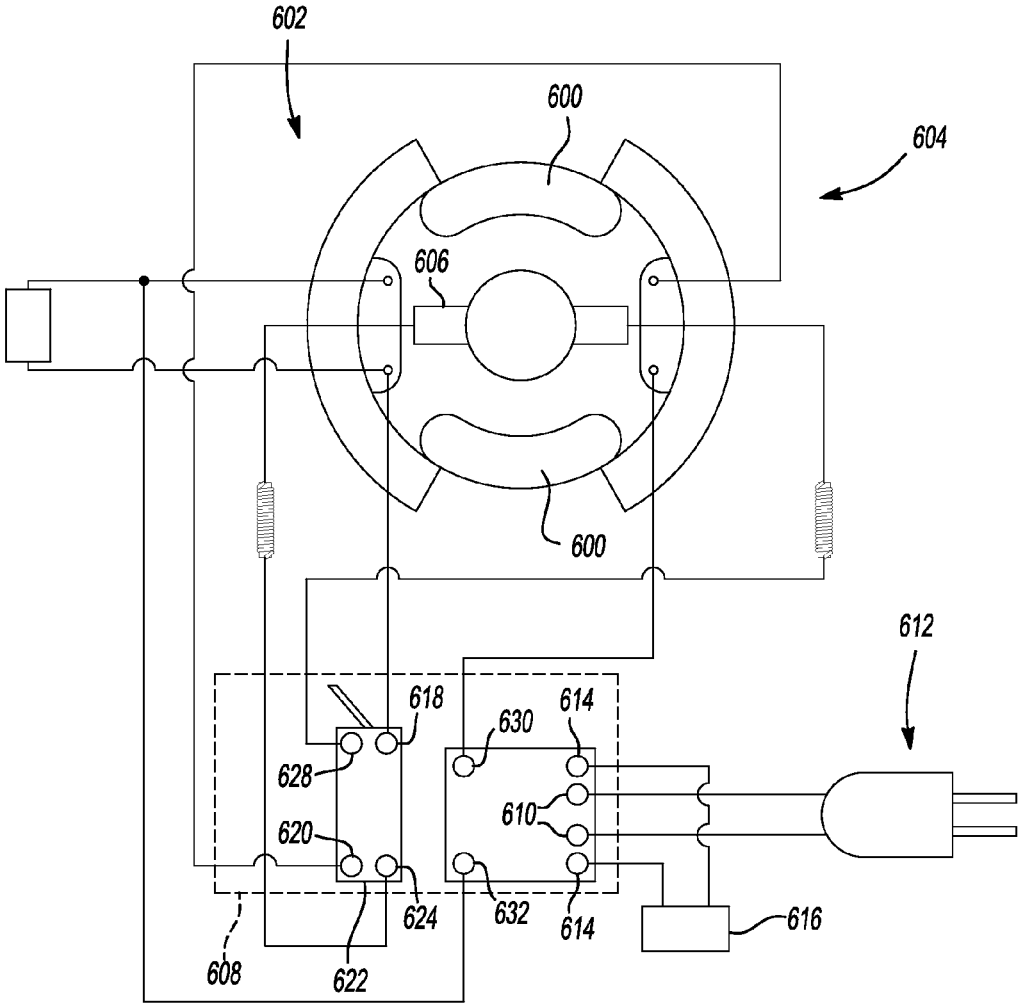
Fig-6 PRIOR ART
FIG. 6 is a simplified wiring diagram of a prior art in-line VSR switch for a 6-wire wire-up.

An overhang switch platform having a universal termination system in accordance with an aspect of the invention utilizes an overhang switch having bottom mounted screw terminals, such as overhang switch 400 of FIG. 4.

Figure 14:
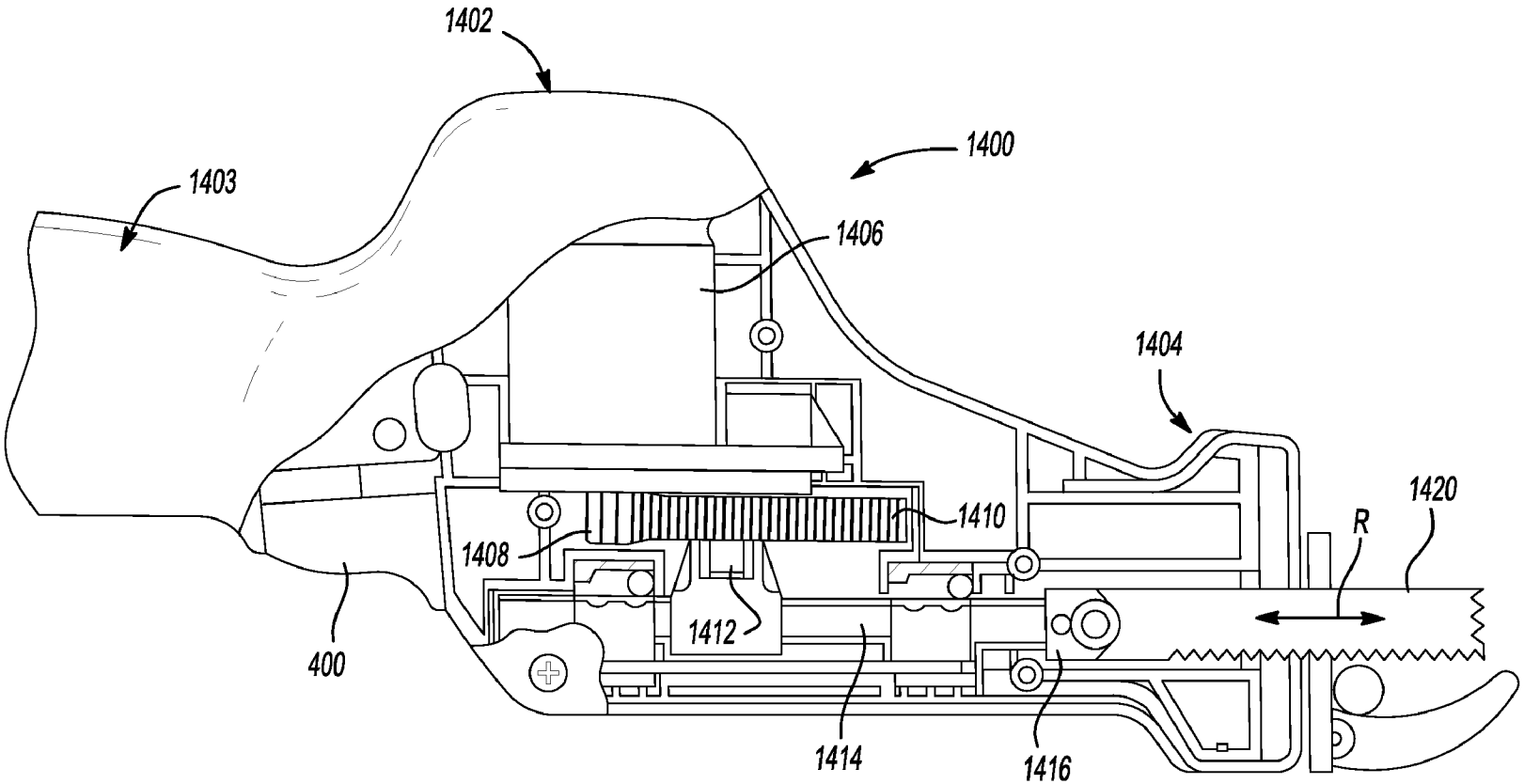
FIG. 14 is a side perspective view of a power tool having an overhang switch.

Turning now to FIG. 14, a power tool 1400 having an overhang switch platform in accordance with the invention is described. Power tool 1400 is shown as a reciprocating saw, but it should be understood that power tool 1400 can be any type of power tool that uses an overhang switch. Reciprocating saw 1400 has the basic characteristics of prior art reciprocating saws, such as the reciprocating saw described in U.S. Pat. No. 6,449,851 for Powered Reciprocating Saw and Clamping Mechanism (the entire disclosure of which is incorporated by reference herein.)

Reciprocating saw 1400 has a housing 1402 having a handle portion 1403 and front portion 1404 from which a reciprocating saw blade 1420 projects through a slot in the front portion 1404, for reciprocation in the directions shown by the arrow R. An electric motor 1406 is mounted within the housing which drives a driving gear 1408. Reciprocating saw 1400 includes an overhang switch in accordance with the invention, such as overhang switch 400 (FIG. 4), that turns motor 1406 on and off. The driving gear 1408 is in engagement with gear wheel 1410. An eccentric pin 1412 is attached to the gear wheel 1410. The eccentric pin 1412 is in engagement with a transverse groove in which it can slide in a direction transverse to the direction of reciprocating movement of the saw blade 1420. The groove is formed in a member which is connected to a reciprocating shaft 1414. Rotation of the gear wheel 1410 thus drives the reciprocating shaft 1414 in a reciprocating movement. At the front end of the reciprocating shaft 1414 a blade holder 1416 is attached which holds the saw blade 1420.

In-Line VSR Switch

An in-line VSR switch platform having a universal termination system in accordance with an aspect of the invention has push-in type terminals for the cord set, capacitor, reversing box and motor connections. The push-in type terminals for the cord set and capacitor are disposed on the bottom surface of the switch body (as in known in-line VSR switches). A release mechanism is provided to release the push-in terminals for the cord set connections to eliminate the need to use a tool to release the cord set leads from the push-in terminals. The push-in type terminals for the reversing box connections are disposed in the sides of the switch body generally at the top of the switch body. The push-in type terminals for the motor connections are disposed in a side of the switch body toward to the top of the switch body (such as in the top 40% of the switch body). The sides of the towards the in-line VSR switch platform further includes push-in type terminals for the reversing box connections which are disposed on sides of the top of the switch body.

Figure 10:
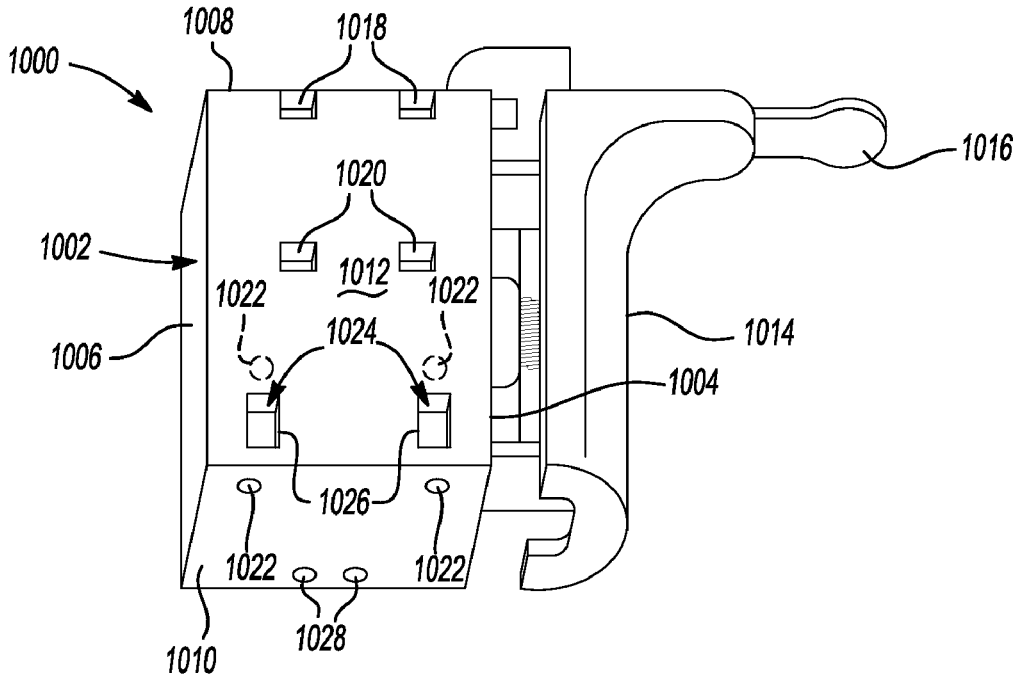
FIG. 10 is a side perspective view of an in-line VSR switch in accordance with an aspect of the invention.

With reference to FIG. 10, an in-line VSR switch 1000 having a universal terminal system in accordance with an aspect of the invention is shown. In-line VSR switch 1000 has a body 1002 having a front 1004, back 1006, top 1008, bottom 1010 and sides 1012. An actuator, such as trigger 1014, extends out from front 1004 of body 1002. A reversing bar 1016 is disposed at a top of trigger 1014.

Two pairs of push-in terminals 1018 that provide the reversing box connections are disposed at generally top 1008 of body 1002 with one pair opening out of one side 1012 of body 1002 and the other pair opening out the other side 1012 of body 1002. Two push-in terminals 1020 that provide the motor connections are disposed in generally the top 40% of body 1002 and open out of one of sides 1012 to provide the motor connections. Two push-in terminals 1022 that provide the cord set connections are disposed in body 1002 and open out bottom 1010 of body 1002. Each push-in terminal 1022 may have associated with it a release mechanism 1024 that is disposed in side 1012 of body 1002. Each release mechanism 1024 may illustratively include a member 1026 that contacts the spring arm of the push-in terminal 1022 so that the lead of the cord set in that push-in terminal 1022 can be released by pushing the member 1026 of the release mechanism. In an alternate construction, terminals 1022 open out side 1012 of body 1002 adjacent release mechanisms 1024 as shown in phantom in FIG. 10. Two push-in terminals 1028 that provide connections for the EMI capacitor are also disposed in body 1002 and open out bottom 1010 of body 1002. It should be understood that all openings for the push-in terminals in body 1002 are flush with the respective surfaces of the body 1002.

Figure 11:
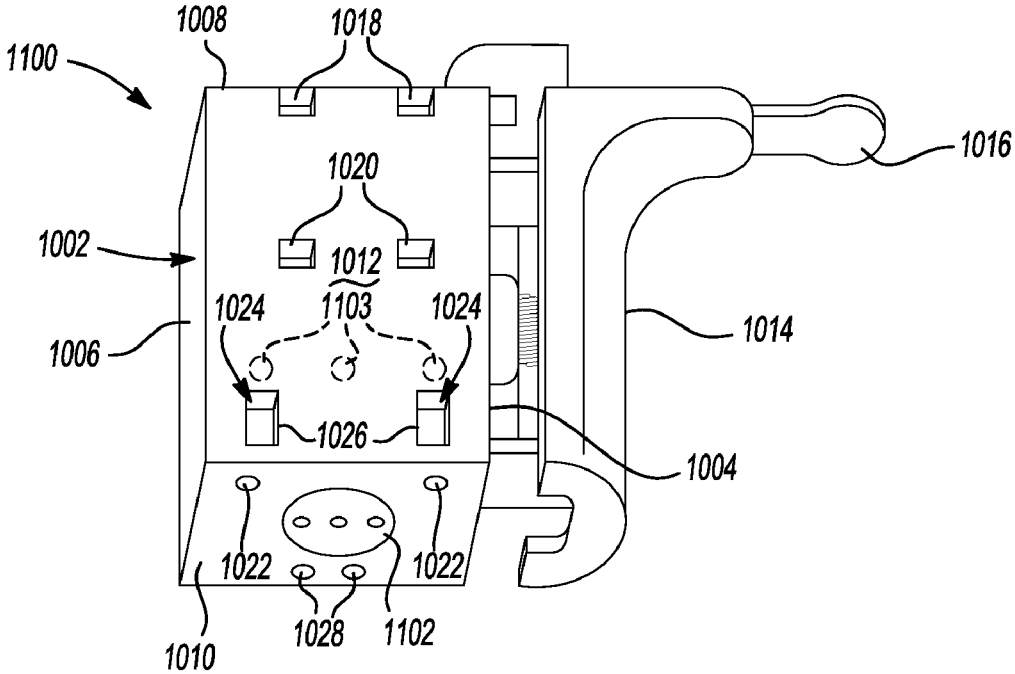
FIG. 11 is a side perspective view of another in-line VSR switch in accordance with an aspect of the invention.
Figure 21:
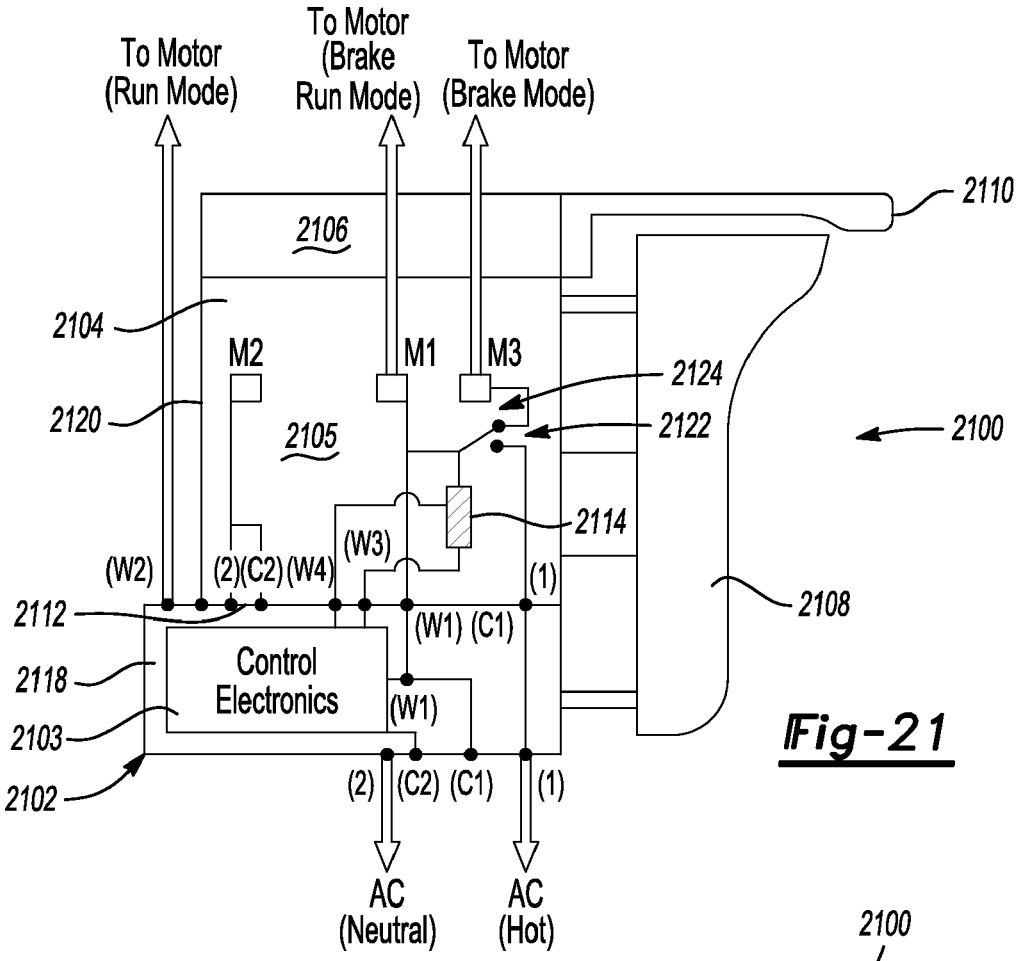
FIG. 21 is a schematic view of a switch having a switch body with standard connections on a bottom that mate with terminals of a plug-in control module.
Figure 22:
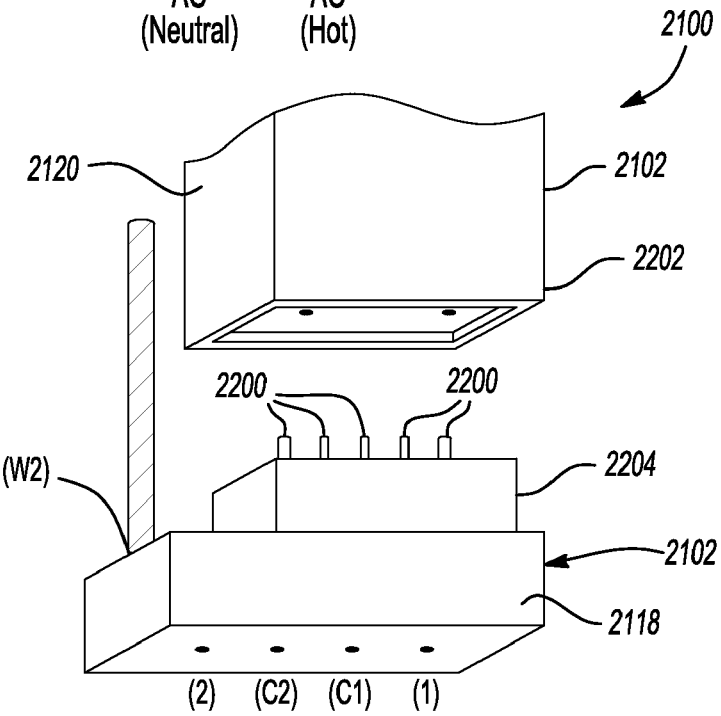
FIG. 22 is a side perspective view, partially broken away, of the switch body and plug-in module of FIG. 21.

FIG. 11 shows an in-line VSR switch 1100 that is a variation of in-line VSR switch 1000 of FIG. 10 and provides a potentiometer output. Common elements will be identified with the same reference numbers and only the differences will be discussed. Body 1002 of In-line VSR switch 1100 includes terminals 1102 (illustratively three) that open in the bottom 1010 of body 1002 that provide connections to an external module (not shown) from a potentiometer (not shown) of in-line VSR switch 1100. Terminals 1102 may illustratively be push-in terminals or tab terminals. In an alternate construction of VSR switch 1100, two or three additional terminations 1103 (shown in phantom in FIG. 11) open out side 1012 of body 1002 above release mechanisms 1024. Terminations 1103, which may illustratively be terminals or wires extending from side 1012, provide control signals to the external module (not shown) indicative of the position of trigger 1014. The external module may illustratively be plugged into the bottom of body 1012, such as plug-in control module 2102 (FIGS. 21 & 22). Terminals 1102 may illustratively be used to provide power to the external module, or one or more of terminals 1102, such as two of them, may be jumpered, such as to one of motor terminals 1020, in such a manner so that power is provided to the external module via one of the terminals 1020 that provide the motor connections.

Figure 12:
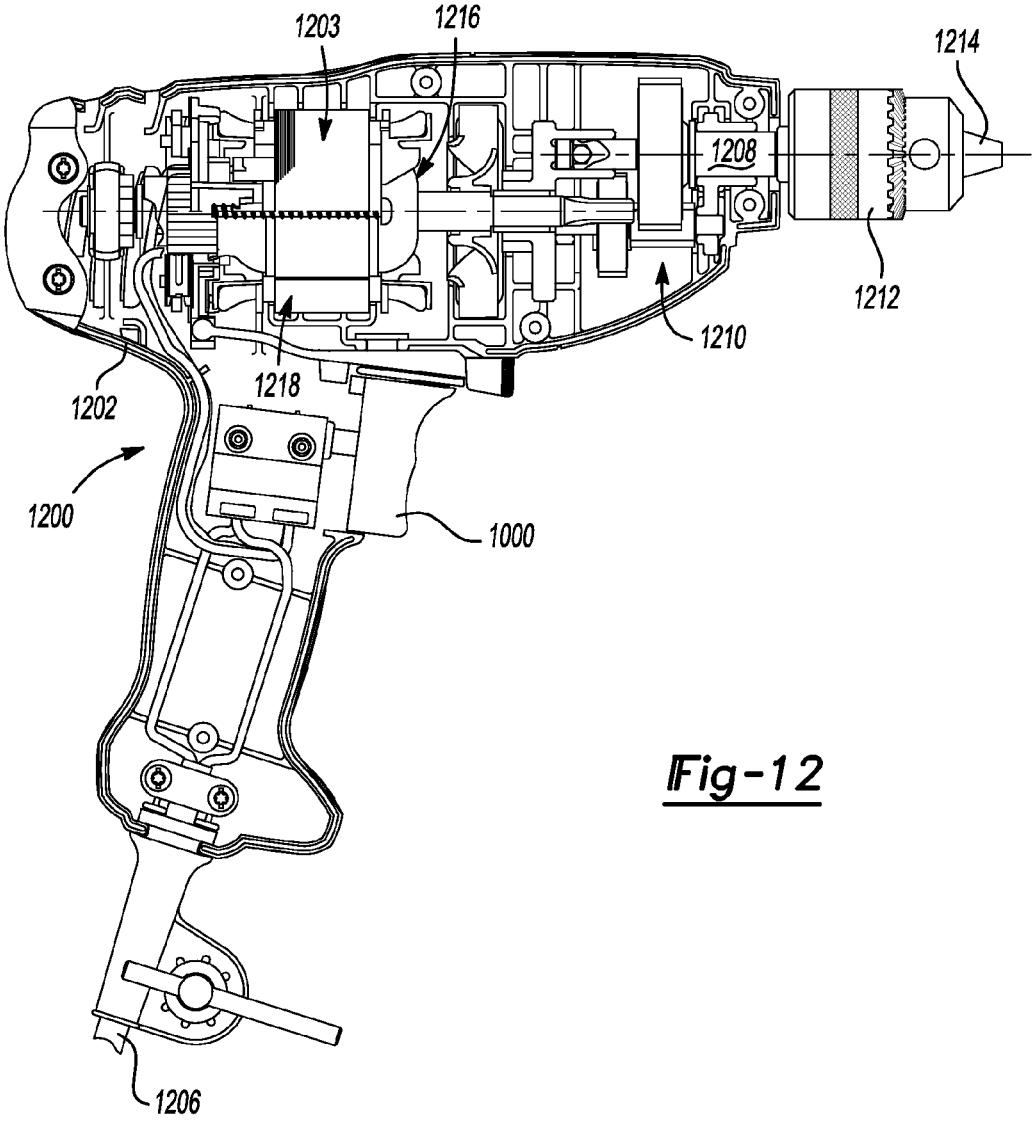
FIG. 12 is a side view of a power tool having an in-line VSR switch switch.

Referring now to FIG. 12, a power tool 1200 having an in-line VSR switch, such as in-line VSR switch 1000 is shown. Power tool 1200 is illustrated as a drill. However, power tool 1200 may be any type of power tool requiring an in-line VSR switch. The power tool 1200 includes a housing 1202 which surrounds a motor 1203. An in-line VSR switch, such as in-line VSR switch 1000, is coupled with the motor and a power source 1206, illustratively AC. The motor 1203 is coupled with an output 1208 via a drivetrain 1210. Output 1208 includes a chuck 1212 having jaws 1214 to retain a tool such as a drill bit (not shown).

Right-Angle Pin Terminals

Figure 15:
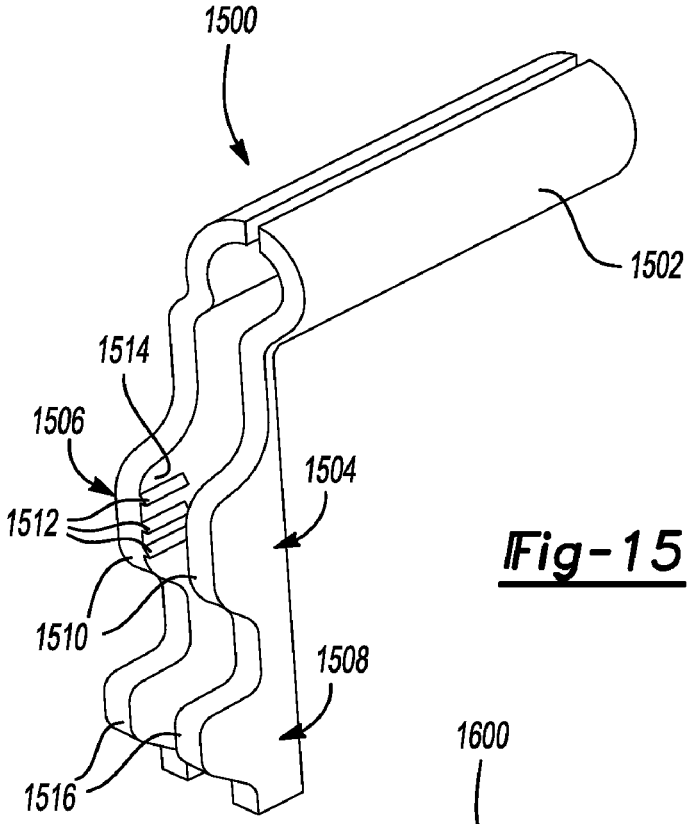
FIG. 15 is a side perspective view of a right-angle pin terminal in accordance with an aspect of the invention.

Referring to FIG. 15, a right-angle pin terminal 1500 that can advantageously be used in the above described universal termination systems is shown. Right-angle pin terminal 1500 includes a barrel or pin portion 1502 extending generally at a right angle from a wire receiving portion 1504. Wire receiving portion 1504 is generally an open sleeve and may illustratively have an insulation support crimp portion 1508. It may also illustratively have an insulation displacing crimp portion 1506. Insulation displacing crimp portion 1506 may illustratively include opposed flanges 1510 with serrations 1512 on inner surfaces 1514 thereof. Insulation support crimp portion 1508 may illustratively include opposed flanges 1516.

A wire is grasped by wire receiving portion 1504 of right-angle pin terminal 1500 as follows. The wire, which may illustratively be an end of a magnet wire used to wind a coil of the motor, is placed in wire receiving portion 1504. Opposed flanges 1510 of insulation crimp portion 1506 are then crimped over the wire. Serrations 1512 pierce the insulation on the wire, which in the case of a magnet wire is an enamel insulation, creating an electrical connection. Opposed flanges 1516 of insulation support crimp portion 1508 are also crimped around the wire to secure the wire to right-angle pin terminal 1500. It should be understood that right-angle pin terminal 1500 could also be used with wires having insulation other than enamel, such as plastic, as well as with magnet wires having enamel insulation.

Figure 16:
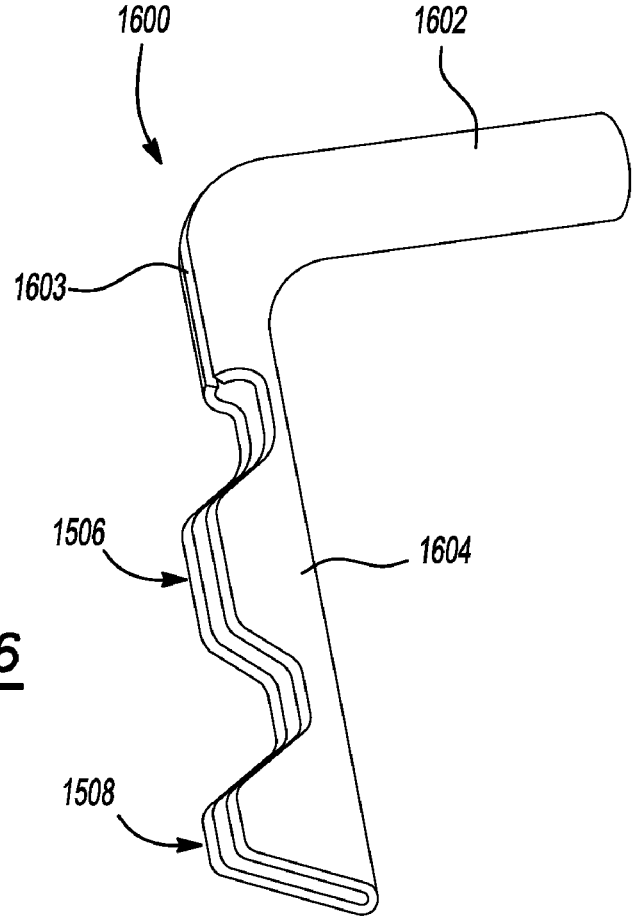
FIG. 16 is a side perspective view of another right-angle pin terminal in accordance with an aspect of the invention.

FIG. 16 shows a variation of the right-angle pin terminal 1500. Elements in common with right-angle pin terminal 1500 of FIG. 15 will be identified with the same reference numbers and the discussion will focus on the differences. In the embodiment of FIG. 16, a right-angle pin terminal 1600 has barrel portion 1602 extending through bend 1603. By extending barrel portion 1602 through bend 1603, right-angle pin terminal 1600 is made stiffer than right-angle pin terminal 1500. This reduces flexing, reducing the risk of right-angle pin terminal 1600 fracturing due to flexing. Stiffening right-angle pin terminal 1600 compared to right-angle pin terminal 1500 also makes it easier to insert it into push in type terminals.

The right-angle pin type terminal, such as right-angle pin terminals 1500 and 1600, provides the advantage of 360 degree orientation with respect to the body of the switch. For example, when used with a push-in type terminal in the switch, the wire receiving portion of the terminal, such as wire receiving portions 1504, 1604, and the wire received in it can be rotatably oriented in any direction with respect to the switch body. In other words, the barrel portion, such as barrel portions 1502, 1602, can be inserted into the push-in type terminal in the switch and the wire receiving portion rotated 360 degrees.

In a power tool having a pistol grip configuration, such as drill 1200 (FIG. 12), it is advantageous to have the motor connections wires exit vertically from the top of the switch (either up or down as applicable) so that the motor lead wires and terminals to which they are attached follow the contours of the pistol grip. In a power tool having a mid-handle configuration, such as an impact wrench, the motor is typically located over the switch and it is therefore preferable to have the motor connections tilt up and back from the top of the switch. Existing termination systems make it difficult to satisfy the requirements of both configurations without introducing kinks in the wires and/or severe bends in the terminals.

Figure 17:
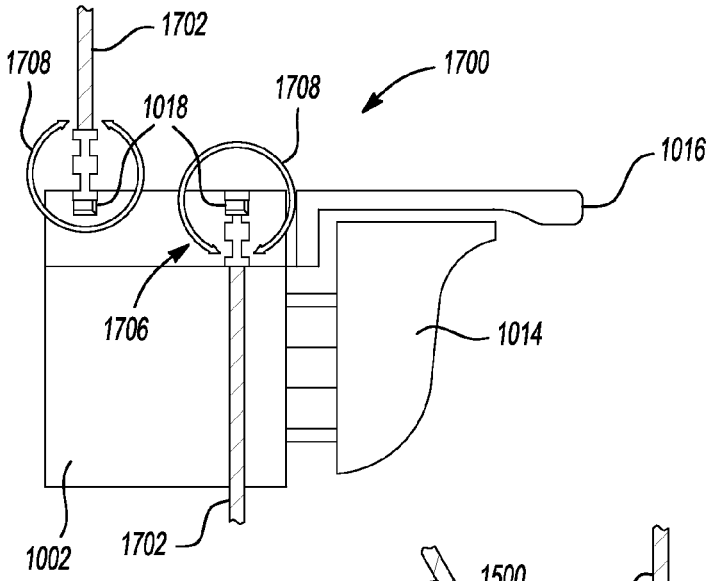
FIG. 17 is a side perspective view of a switch utilizing the right-angle pin terminal of FIG. 15 or 16.

The right-angle pin terminal, such as right-angle pin terminals 1500, 1600, permit the terminal to be inserted into the switch and have the wires, such as the wires for the motor connections, leave the switch in the appropriate orientation for the respective pistol grip and mid-handle configurations. FIG. 17 shows a right-angle pin terminal, such as right-angle pin terminal 1500, used in a power tool having a pistol grip configuration, such as drill 1200, having an in-line VSR switch 1700 platform. In-line VSR switch 1700 is similar to in-line VSR switch 1000 (FIG. 10) and the same reference numbers will be used to identify like elements. For clarity, only switch 1700, right-angle pin terminals 1500 and motor leads 1702 are shown in FIG. 17. Wires 1702 are attached to right-angle pin terminals 1500 by wire receiving portions 1504 as described above. Barrel portions 1502 of right-angle pin terminals 1500 are inserted into push-in terminals 1018 of the reversing box 1706 of switch 1700. Wire receiving portions 1504 of right-angle pin terminals 1500 are rotatable three-hundred and sixty degrees, as shown by arrows 1708, so that they can be oriented vertically with respect to switch body 1002 of switch 1700, with the wires 1702 exiting switch 1700 vertically (either up or down as the case may be) as oriented in FIG. 17.

The right-angle pin terminals, such as right-angle pin terminals 1500 and 1600, also allow the connections to exit almost flush with the sides of the switch, such as shown in FIG. 17, and thus do not add in any great degree to the overall width of the switch platform. This facilitates the ability to provide a more ergonomic grip around the switch.

Figure 18:
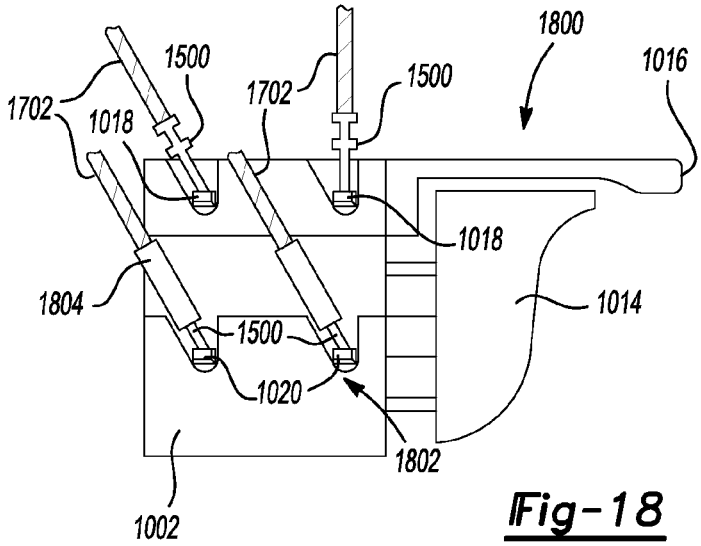
FIG. 18 is a side perspective view of a switch of FIG. 17 modified to have features in the switch body that cooperate with the right-angle pin terminal in accordance with an aspect of the invention.

With reference to FIG. 18, features 1802 are molded in the body of a switch 1800 to cooperate with the right-angle terminals 1500, 1600 to limit the angular orientation of right-angle terminals 1500, 1600 in switch body 1002 to help ensure spatial separation. Only one such feature is shown in FIG. 18 for clarity, but it should be understood that switch body 1002 can have multiple features 1802, such as for each push-in terminal in which a right-angle terminal is received. Switch 1800 is shown illustratively in FIG. 18 as an in-line VSR switch similar to switch 1000 of FIG. 10 and switch 1700 of FIG. 17, with the same reference numerals used to identify like elements. It should be understood, however, that switch 1800 could be other types of switches, such as a push-button switch or overhang switch.

Figure 19:
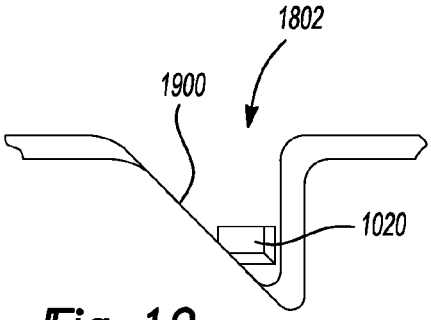
FIG. 19 is a side perspective view of an embodiment of the feature in the switch body of FIG. 18 that is a well.
Figure 20:
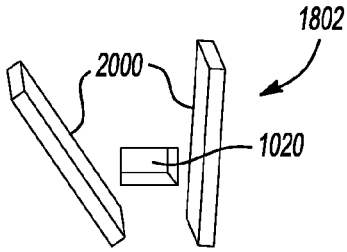
FIG. 20 is a side perspective view of an embodiment of the feature in the switch body of FIG. 18 that includes opposed walls.

Features 1802 may illustratively be sunken wells 1900 (FIG. 19) or raised walls 2000 (FIG. 20) disposed around the push-in terminals 1018, 1020, 1022 (FIG. 10), of switch 1800. Limiting the angular orientation of right-angle terminals 1500, 1600 in switch body 1002 helps ensure that they remain spatially separated, reducing or eliminating the risk of inadvertent electrical shorting between adjacent terminals.

With reference to FIG. 18, in another variation, a sleeve 1804, such as a heat shrink tube or similar coating/covering, is placed around the wires 1702 where they are received in the wire receiving portions of the terminals, such as wire receiving portion 1504 of right-angle pin terminal 1500. In this regard, sleeve 1804 may extend around both the wire receiving portion 1504 and a portion of the wire 1702 extending from wire receiving portion 1504. Sleeve 1804 provides added support around the wire 1702 where it connects to the right-angle pin terminal 1500. This may be advantageous in applications where fine wires are used, such as may be the case in high voltage motors. Sleeve 1804 also protects against inter-terminal shorting. Extending sleeve 1804 to the radius of the bend of the right-angle pin terminal (such as bend 1603 of right-angle pin terminal 1600), may, in some applications, protect against tracking. Tracking, as is known, occurs when a conductive path is formed from foreign material (such as dirt, water, sweat, metal particles) between internal elements of the power tool and accessible external points on the tool.

The right-angle pin terminals, and particularly when used with switches having the above described switch body features, provide a flexible means to accommodate the demands of different tool configurations without significant switch or wiring changes. For example, they allow a single switch platform to be used for both pistol grip and mid-handle designs without compromising on the integrity of the wiring in either design.

Right-angle pin terminals 1500 and 1600 are pre-formed as right-angle pin terminals. That is, they are formed during manufacturing as right-angle pin terminals. A right-angle pin terminal can also be formed by attaching a wire to a wire receiving portion of a straight pin terminal and then bending the wire with respect to the pin or barrel portion of the straight pin terminal so that wire is at a right angle to the pin portion. This is described in more detail below with reference to FIGS. 24A to 24C.

Figure 24A:
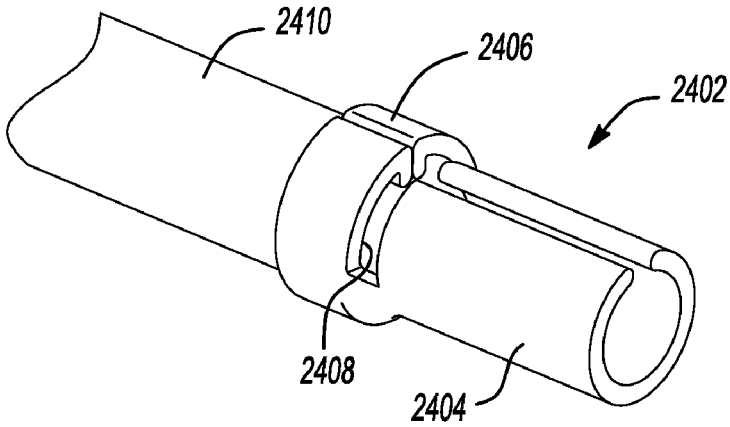
FIG. 24A-24C are perspective views of forming a right-angle pin terminal by bending a wire after it is affixed to a straight pin terminal.
Figure 24B:
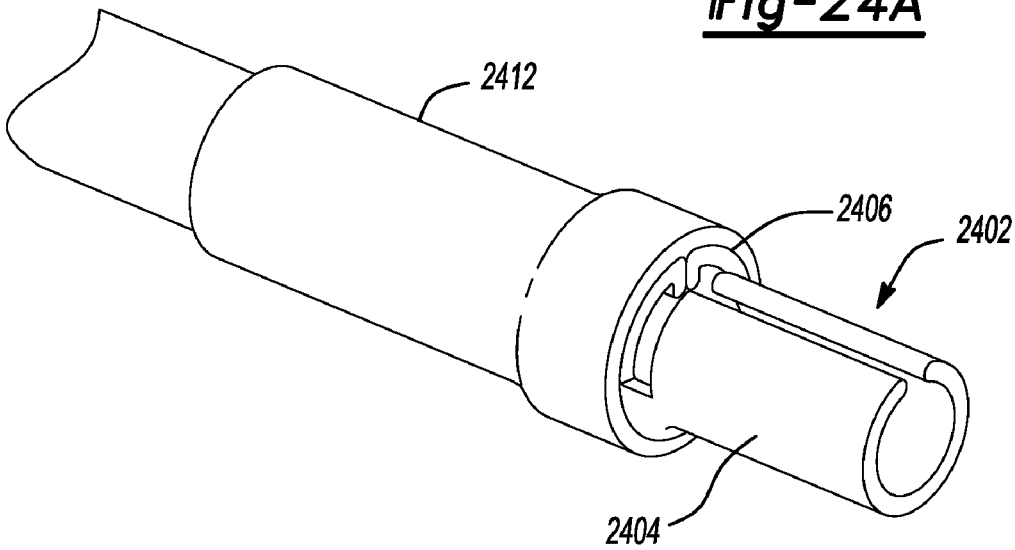
Figure 24C:
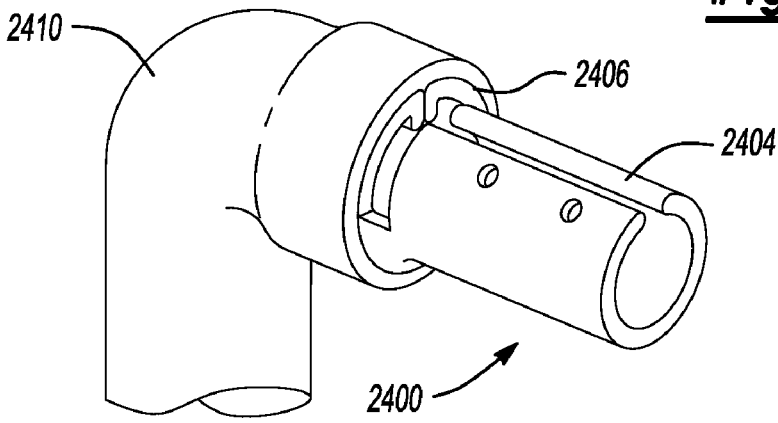

FIGS. 24A-24C illustrate forming a right-angle pin terminal 2400 (FIG. 24C) by bending a wire attached to a straight pin terminal 2402 (FIG. 24A). With reference to FIG. 24A, straight pin terminal 2402 includes a pin or barrel portion 2404 and a wire receiving portion 2406. Wire receiving portion 2406 includes an insulation crimp portion 2408 and may also illustratively include an insulation support crimp portion (not shown). An end of wire 2410 is placed in wire receiving portion 2406 and insulation crimp portion (and insulation support crimp portion as applicable) crimped around the end of wire 2410. Optionally, as shown in FIG. 24B, an insulation sleeve 2412, such as a piece of heat shrink tubing, is placed over wire receiving portion 2406 and a portion of wire 2410 extending from wire receiving portion 2406. The pin portion 2404 of straight pin terminal 2402 is then inserted into a terminal of a switch up to wire receiving portion 2406 and wire 2410 then bent behind that point so that wire 2410 is at generally a right angle to pin portion 2402, thus forming right angle pin terminal 2400. If optional insulation sleeve 2412 is used, it provides extra strength for the bend in wire 2410.

Turning to FIGS. 21 and 22, a switch 2100, shown illustratively as an in-line VSR switch, configured for use with and without a plug-in control module 2102 is described. Switch 2100 includes a body 2104, a reversing box 2106, a trigger 2108 and a reversing bar 2110. It also includes motor terminals M1, M2, M3 in a side 2105 of switch body 2104. An underside or bottom 2112 of switch body 2104 has a plurality of standard connections or terminals, illustratively six as follows: connection (1) and connection (2) (which is connected to M2) for connection to AC hot and AC neutral, respectively; C2 (internally jumpered to (2)) for connection of one side of an external EMI capacitor (not shown); W3 and W4 that connect to internal variable resistance element 2114 (e.g., potentiometer, strip with discrete resistors); (W1/C1) (which is connected to M1) that provides a common connection for variable resistance element 2114 and for connection of a second side of the external EMI capacitor. These standard connections on the bottom 2112 of switch body 2104 may illustratively be female terminals.

As best shown in FIG. 22, module 2102, which illustratively includes control electronics 2103 for controlling a motor of the power tool having switch 2100, has male terminals 2200 that plug into the standard connections or terminals on the bottom 2112 of switch body 2104 of switch 2100. That is, terminals 2200 of module 2102 plug into the (W4), (W3), (W1/C1) and (1) female terminals in the bottom 2112 of switch body 2104. It should be understood that the standard connection or terminals on the bottom 2112 of switch body 2104 may have male terminals and the module 2102 have female terminals.

Module 2102 also includes a connection (W2) to which a motor lead is connected instead of being connected to (M2). The other motor lead is connected to (M1) of switch 2100. When module 2102 is used with switch 2100, no connections are made to terminals (2) and (C2) on the bottom 2112 of switch body 2104.

In the embodiment shown in FIG. 21, an underside or bottom 2116 of module 2102, illustratively includes four connections, two for AC (hot and neutral), also designated as (1) and (2), and two for the connection of the external EMI capacitor, also designated as (C1), (C2). In a variation, the EMI capacitor can be included in module 2102.

Module 2102 may illustratively be shaped so that a portion 2118 having connection (W2) extends out beyond a side 2120 of switch body 2104. This facilitates access to connection (W2) on module 2102.

As mentioned, switch 2100 can be used with or without module 2102. If switch 2100 is used without module 2102, the standard connections provided on the underside or bottom 2112 of switch body 2104 and motor connections M1, M2 and M3 in the side of switch body 2104 provide all the necessary connections for switch 2100 so that switch 2100 can be common for applications that utilize external control electronics, such as control electronics 2103 in module 2102, and those that do not. In this regard, in applications where module 2102 is not used, connections (W3) and (W4) in the bottom 2112 of switch body 2104, since they are used only to provide connections to module 2102, can be left out of the switch 2100 to reduce cost. By having the standard connections or terminals on the bottom 2112 of switch body 2104 with module 2102 having mating terminals, the connection of an external electronic control, such as control electronics 2103 in module 2102, is simplified with most of the connections made by the mating of terminals 2200 of module 2102 with the standard connections or terminals in the bottom 2112 of switch body 2104 as opposed to using the typical connection scheme that utilizes flying lead wires.

With reference to FIG. 22, switch body 2104 may include feature(s) 2202 that cooperate with corresponding feature(s) 2204 of module 2102 to secure module 2102 to switch 2100. For example, feature(s) 2202 may include a skirt/partial skirt that extends from the periphery of bottom 2112 of switch body 2104 and wraps around feature(s) 2204 of module 2102, which may illustratively be a pedestal from which terminals 2200 extend. Feature(s) 2202 and 2204 may also include snap-fit features that lock together.

With reference to FIG. 21, switch 2100 includes primary contacts 2122, which are normally open contacts that are closed when trigger 2108 is pressed to energize the motor (not shown) of the power tool in which switch 2100 is used. Switch 2100 may also include secondary or braking contacts 2124, which are normally closed contacts, one side of which is connected to connection (M3). In the RUN mode when trigger 2108 is pulled, current flows from (1), through primary contacts 2122 which are closed, and out from (M1) to the motor and returns from the motor either to (W2) when switch 2100 has module 2102 or to (M2) when it does not. In the BRAKE mode, when trigger 2108 is released, (M1) and (M3) are shorted by braking contacts 2124, which shorts a brake winding of the motor to brake the motor. In those applications where the motor of the power tool does not have a separate brake winding, braking contacts 2124 and connection (M3) can be left out of switch 2100 to reduce cost.

Figure 23:
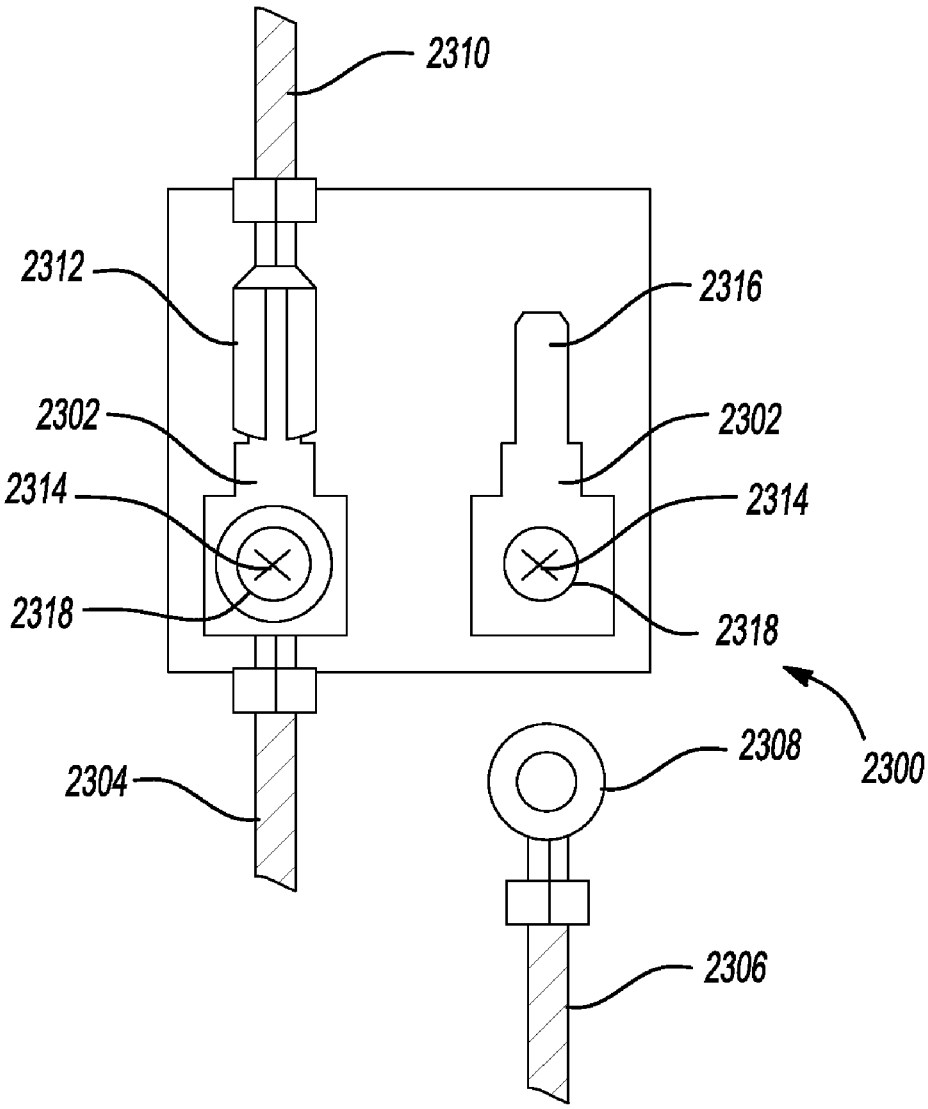
FIG. 23 is a perspective view of a switch having cord-set terminals that are combination screw-tab terminals.

In an aspect, screw-tab terminals are used for the cord set terminals of the switches. As shown representatively in FIG. 23, a switch 2300 for a hand-held power tool has a set of cord-set terminals secured therein that are screw-tab terminals 2302. Each screw-tab terminal has a tab 2316 and a threaded screw hole 2318 for receiving a screw 2314. The cord set may illustratively include cord set wires 2304, 2306 with eyelets 2308 (only one of which is shown in FIG. 23) at ends thereof. Eyelets 2308 are secured to screw-tab terminals 2302 by screws 2314 that are tightened in threaded screw holes 2318. An additional wire, shown illustratively by wire 2310, for the wire-up of the power tool in which 2300 is used, can also be connected to each screw-tab terminal 2302. Each such wire 2310 has a female tab terminal 2312 at an end thereof that mates with the tab 2316 of screw-tab terminal 2302. It should be understood, however that tabs 2316 could be female tab terminals in which case female tab terminal 2312 at the end of wire 2310 would be replaced by a tab.

The use of screw-tab terminals 2302 for the terminals of the set of cord set terminals allows the wires 2304, 2306 of the cord set to be removed from screw-tab terminals 2302 without disturbing the connection of another wire that is also connected to one of the screw-tab terminals 2302, such as wire 2310. This allows more than one wire to in effect be under a single screw of each screw-tab terminal. Since some listing agencies require that the cord set of a hand-held power tool be replaceable without disturbing the connection of other wires, an extra tab component has had to be provided for each screw terminal of prior art systems to allow the cord set to be connected with other wires of the wire up under a single screw. The screw-tab terminals 2302 eliminate the need for this extra tab component yet still allow a wire in addition to a wire of the cord set to be connected to each of the terminals of the set of cord set terminals and meet the requirement of allowing the cord set to be removed without disturbing the connections of these other wires.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A switch assembly for a hand-held power tool, comprising:

a switch having at least one push-in terminal; and a right-angle pin terminal received in the push-in terminal of the switch, the right-angle pin terminal comprising a pin portion elongated along a first axis and a wire receiving portion elongated and extending along a second axis away from the first axis generally at a right angle to the pin portion, the wire receiving portion including a generally open sleeve.

2. The apparatus of claim 1 wherein the wire receiving portion includes an insulation support crimp portion.

3. The apparatus of claim 2 wherein the insulation support crimp portion includes opposed flanges.

4. The apparatus of claim 1 wherein the wire receiving portion includes an insulation displacing crimp portion.

5. The apparatus of claim 4 wherein the insulation displacing crimp portion includes opposed flanges with serrations on inner surfaces of the opposed flanges.

6. The apparatus of claim 1 wherein the pin portion is a barrel portion.

7. The apparatus of claim 6 wherein the barrel portion includes a straight portion and a portion with a right angle bend with the wire receiving portion extending from an end of the right angle bend portion of the barrel portion so that the wire receiving portion is at a right angle to the straight portion of the barrel portion.

8. The apparatus of claim 1, wherein the wire receiving portion is defined by opposed flanges extending in a direction of an end of the pin portion.

9. The apparatus of claim 8, wherein the opposed flanges are identically shaped.

10. The apparatus of claim 1, wherein the wire receiving portion is rotatable with respect to the switch around the pin portion.

* * * * *